United States Patent [19]

Crump et al.

[11] 4,027,765

[45] June 7, 1977

[54] RECORD MEDIA DRIVE MECHANISM

[75] Inventors: Leslie L. Crump; Victor J. Italiano, both of Trumansburg, N.Y.

[73] Assignee: NCR Corporation, Dayton, Ohio

[22] Filed: July 31, 1975

[21] Appl. No.: 600,699

[52] U.S. Cl. ..... 197/133 R; 197/128; 197/127 R; 197/129; 226/179

[51] Int. Cl.[2] ..... B41J 15/00

[58] Field of Search ..... 197/126 R, 126 A, 126 B, 197/127 R–133 R, 133 T, 133 P, 1 R, 138 R, 138 A; 226/75, 109, 110, 179

[56] References Cited

UNITED STATES PATENTS

| | | | |
|---|---|---|---|
| 1,820,258 | 8/1931 | Vickers | 197/128 |
| 2,069,489 | 2/1937 | Eagan | 197/128 |
| 2,530,156 | 11/1950 | Eagan | 197/128 |
| 3,334,722 | 8/1967 | Bernard | 197/133 R |
| 3,407,981 | 10/1968 | Staugaard | 226/179 X |
| 3,653,483 | 4/1972 | Cortona et al. | 197/129 |
| 3,721,377 | 3/1973 | Atkinson | 226/179 X |
| 3,815,722 | 6/1974 | Sessoms | 197/127 R |
| 3,825,681 | 7/1974 | Cederberg et al. | 197/1 R X |
| 3,837,461 | 9/1974 | Waibel | 197/126 A |

*Primary Examiner*—Ralph T. Rader
*Attorney, Agent, or Firm*—J. T. Cavender; Wilbert Hawk, Jr.; George J. Muckenthaler

[57] ABSTRACT

A plurality of printing stations are spaced across a machine wherein a feed or drive assembly for paper or like record media is associated with each station, each of the feed or drive assemblies being self-contained and of modular construction to enable positioning of an assembly in any desired location along a drive shaft. One drive mechanism includes a clutch member and associated drive gears and rollers to incrementally advance receipt paper in one direction, a second drive mechanism includes the clutch member and additional drive gears and rollers to advance journal paper in said one direction for rewinding and storage thereof in the machine, and a third drive mechanism includes the clutch member and further drive gears and rollers to advance slip or form paper in the opposite direction.

18 Claims, 8 Drawing Figures

RECORD MEDIA DRIVE MECHANISM

BACKGROUND OF THE INVENTION

In the area of higher speed printing, prior apparatus and machines have included provisions for printing on a plurality of record media at the several stations across a business machine. In one construction, there may be provided a single print head or like mechanism which remains at one place or station and the several record media are directed past the printing station to accomplish printing on the desired media. In another construction, there may be provided record or printing media at several stations across the machine with a plurality of movable print heads, each associated with its station for printing the desired information on the record media. In the modern business machine, a normal or common type of construction may include a receipt station, a journal or audit station, and a slip or form station wherein, respectively, a receipt is printed and provided to the customer, a journal or an audit is printed and retained or stored in the machine, and a form or slip, which may be in the manner of a pass book or a document, is inserted and certain information is printed thereon and then returned to the customer (in the case of a pass book) or deposited in a receptacle for further processing (in the case of a check or like document). Representative of prior art showing such an arrangement of printing stations is Cederberg et al. U.S. Pat. No. 3,825,681 which discloses the several stations adjacent one another for performing the several functions.

With the advent of more compact construction in business machines, it is desirable that the several functions or modes of operation of such machines be compatible for precise and high speed operation. Additionally, the several functions are desired to be built in a structure and manner which will simplify the design in the matter of using common parts in a modular concept.

SUMMARY OF THE INVENTION

The present invention relates to printing apparatus and more particularly to paper or like record media feed or drive mechanisms wherein a plurality of functions are performed in a machine and wherein each feed or drive mechanisms is a self-contained assembly which may be placed or positioned in any of several printing station locations along a drive shaft. Each of the several feed or drive mechanism is used to convert the drive shaft rotational motion into incremental or intermittent motion to advance the different record media in line feed or incremental manner past the respective printing station. A portion of each media drive mechanism is structured to provide a modular concept with certain like drive and driven elements including a clutch member, and variations or modifications and additional elements are then introduced and included in the basic assembly to perform the different functions.

In such basic assembly of the media drive structure, the drive mechanism includes side frames which supporting and connecting means therebetween, a clutching device driven by an input shaft and means for incrementally actuating respective drive and driven gears and rollers to feed the record media in one direction when providing a receipt of the transaction. A second function of the printer and drive mechanism is that of providing a journal or audit trail wherein the side frames, the clutching device, and certain driven gears and rollers, corresponding to the parts in the basic assembly, are assembled, and additional rollers are included to drive and to take up the journal paper in the one direction for the purpose of retaining or storing the paper in the machine. Another function of the drive mechanism utilizes the side frames, the clutching device, and certain driven gears and rollers together with additional drive and driven elements to advance a form or slip in the other direction to thereby position the form or slip for printing information thereon for return to the customer or for deposit in a receptacle by the operator.

The machine can accommodate one, two, or all three drive mechanisms, there being provided a common drive shaft and a pair of supporting or aligning shafts to maintain the drive mechanisms in position relative to the printing mechanisms.

In view of the above discussion, the principal object of the present invention is to provide a plurality of self-contained record media drive mechanisms in a printer.

Another object of the present invention is to provide a plurality of drive mechanisms utilizing a modular type design applicable for the several functions in a printer.

An additional object of the present invention is to provide a basic drive mechanism and variations thereof for performing several functions in a printer.

A further object of the present invention is to provide a plurality of drive mechanisms having common elements and adaptable for driving record media in incremental or intermittent manner in the several functions of printing for different transactions.

Additional advantages and features of the present invention will become apparent and fully understood from a reading of the following description taken together with the annexed drawings, in which.

Figure 1:
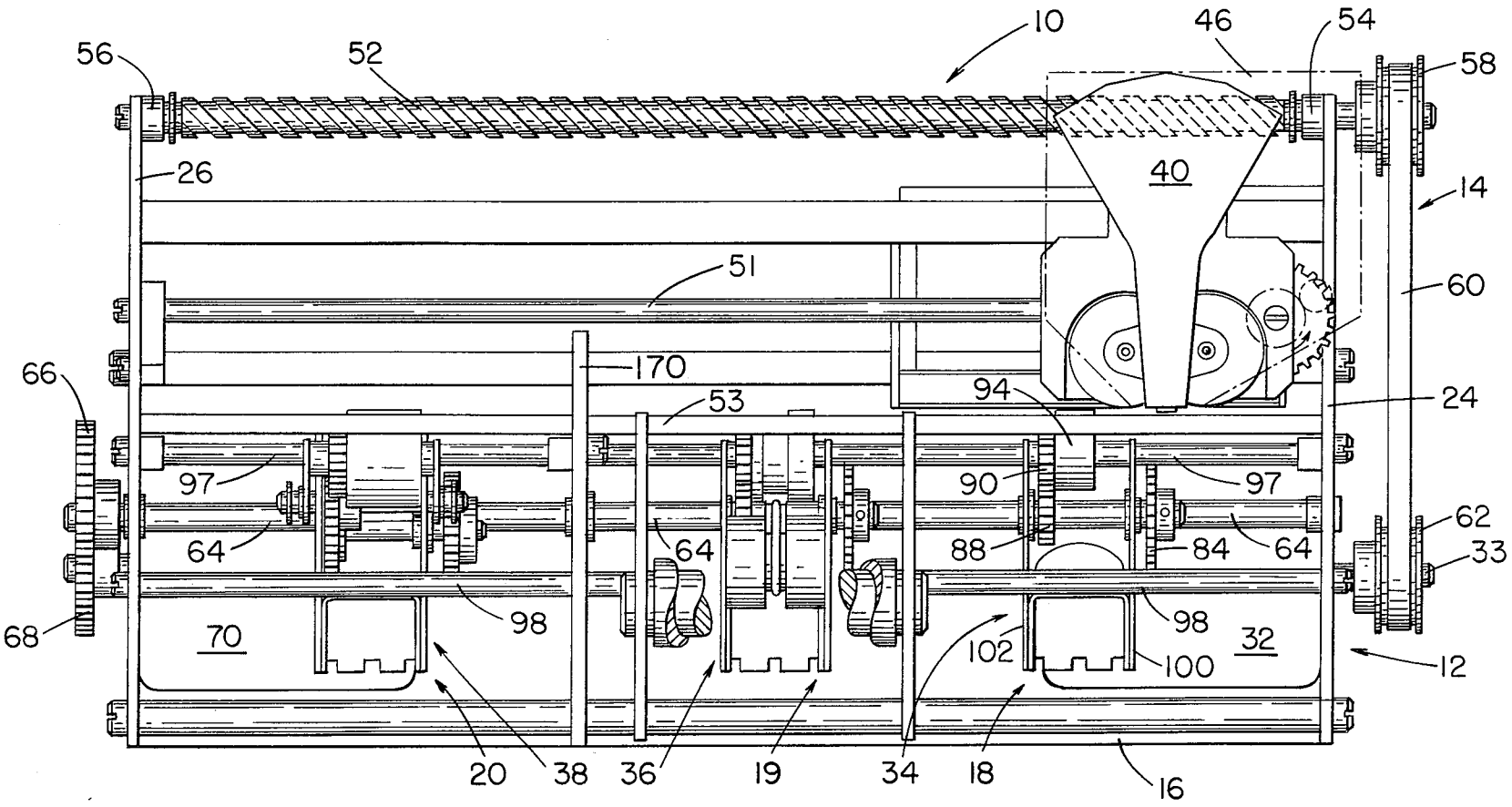
FIG. 1 is a front elevational view of a printer incorporating the subject matter of the present invention.
Figure 2:
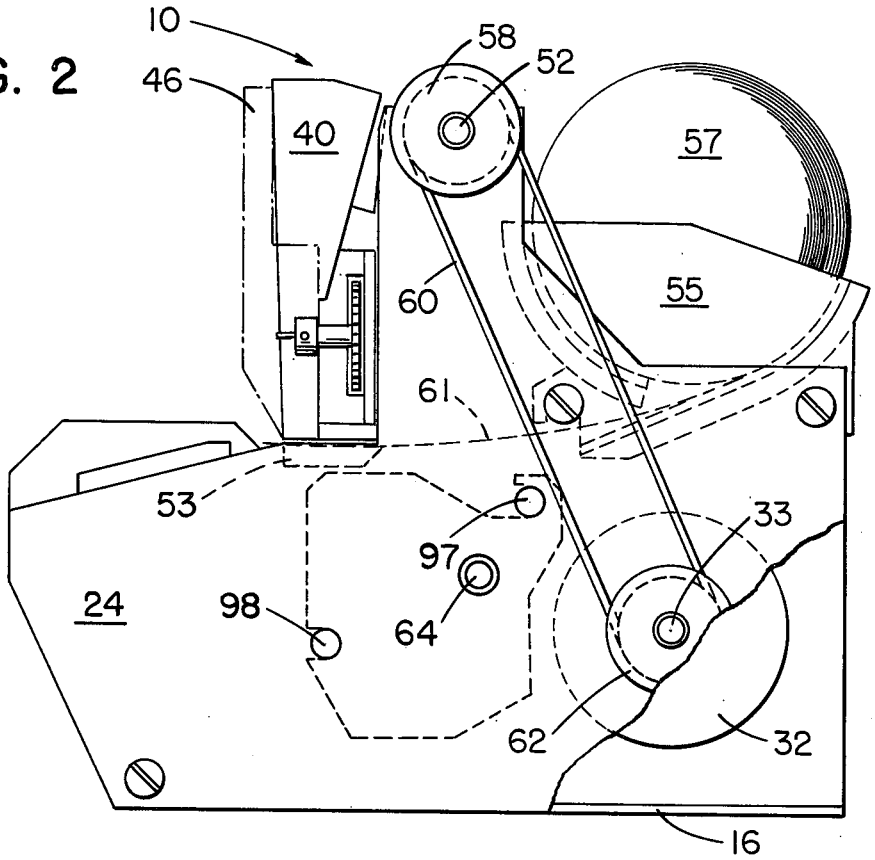
FIG. 2 is a right side elevational view of the printer shown in FIG. 1.

Referring now to FIGS. 1 and 2 of the drawing, there is shown printer structure of limited illustration wherein a business machine is designated generally as 10 and includes lower and upper portions 12 and 14, respectively, the lower portion including a supporting base 16 and upstanding machine framework providing compartments 18, 19 and 20 for containing various machine elements which are an important part of the present invention. The machine framework includes side walls 24 and 26 connected by suitable rods or rail members for supporting or carrying such machine elements, there being a pair of spaced members for a purpose to be later described, along with additional frame members for carrying the printing mechanism.

A prime mover which may be in the form of a motor 32 is located at the right, lower rear area of the machine lower portion 12 and such motor supplies energy for the various operating members of the machine, one of which is printing mechanism which is made to travel in a side-to-side direction while effecting the printing operation.

Although the printing mechanism may be one of several types, the present invention is directed to a design which includes a matrix type print head positioned in a generally upright manner and carried or driven back and forth across the machine 10. The printing mechanism may comprise one or more of such print heads for operating at one or more print stations. In a business machine of the printer type with which the present invention may be particularly useful, a plurality of such print stations may be appropriately named a receipt station 34, a journal station 36, and a slip or form station 38, with a print head 40 operating across each station. Forward of the print head 40 and connected thereto to be carried thereby may be a ribbon cassette 46, shown in outline form in FIGS. 1 and 2, the detailed structure of which is fully disclosed in a copending application covering the invention of Hillis L. Wilson, U.S. Ser. No. 467,418, filed May 6, 1974, and assigned to the same assignee as the present invention. While a plurality of print heads, such as head 40, and ribbon cassettes, such as cassette 46, may be utilized to perform the various printing functions, only one print head and cassette assembly is herein required to operate across the several print stations 34, 36, 38 of the machine 10.

The print head 40 and the cassette 46 are moved in such side-to-side direction by means of a lead screw 52 which is positioned across the top of the machine 10 and which is journaled in a bearing 54 at side wall 24 and in a bearing 56 at side wall 26. A timing pulley 58 is supported at the right side of and connected to lead screw 52 and a timing belt 60 connects the pulley 58 with a pulley 62 on the motor shaft 33. By appropriate control mechanism, the motor 32 drives, by means of the pulley 62, the belt 60, and the pulley 58, the lead screw 52 to move the print head 40 and the cassette 46 in the desired side-to-side motion for printing. A lower guide or support rod 51 (FIG. 1) spaced from lead screw 52 carries the print head 40 in a precise and straight path across the machine and above a platen 53, FIG. 2. A tray 55 supports one or more paper rolls 57 which serve as supply means for paper or like record media 61 as the media is being advanced past the respective printing station.

Figure 4:
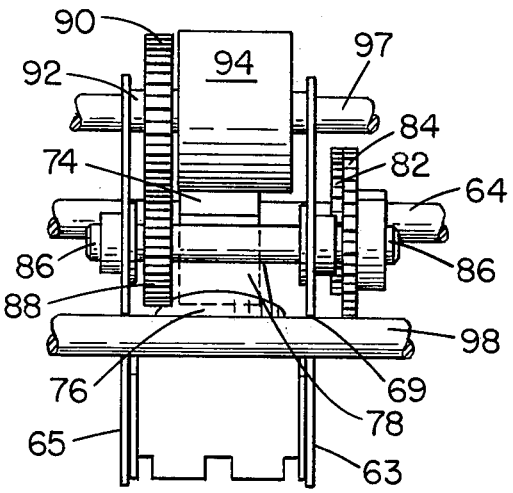
FIG. 4 is a front elevational view of the drive mechanism shown in FIG. 3.
Figure 3:
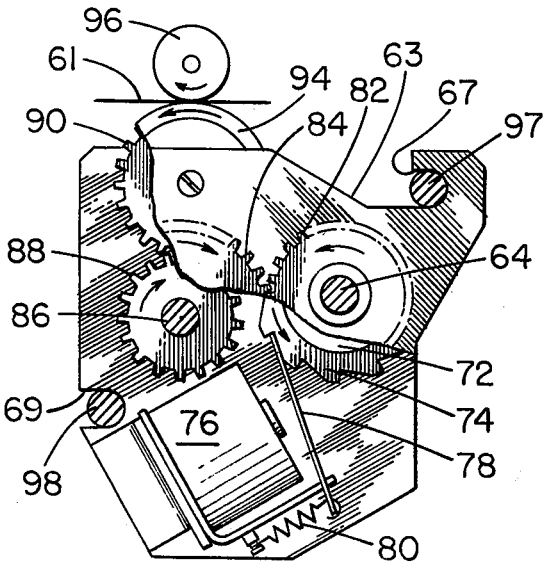
FIG. 3 is an enlarged right side elevational view of a drive mechanism for the receipt station of the printer.

Referring additionally to FIGS. 3 and 4 which show in side and front elevation, respectively, the paper feed or drive mechanism for advancing the paper or like media 61 past the receipt station 34 (at the right side of machine 10), a clutching assembly, contained generally between side plates 63 and 65 having formed cut-outs 67 and 69 therein for a purpose to be described, derives its motion from an input drive shaft 64 which spans the width of the machine 10 and is journaled in the side frames 24 and 26, and which shaft 64 is driven counterclockwise (FIG. 3) through appropriate gears 66, 68 from a motor 70, FIG. 1. Shaft 64 extends through a spring clutch 72 (FIGS. 3 and 4) of the shaft input output hub type at the receipt station 34 drive mechanism, the clutch 72 having a cogged collar or ratchet 74 in its central section, which collar 74, when restricted in movement, releases the clutch spring from the output hub and disengages the clutch 72. A solenoid 76, shown in de-energized condition, has a pawl 78 biased by a spring 80 which holds the clutch release collar 74 in a disengaged position when the pawl 78 is engaged with one of the cogs or teeth on such collar 74. When the solenoid 76 is energized, the pawl 78 is pulled from the cogs or teeth of the collar 74 and the clutch is caused to be engaged with the output hub for rotational driving thereof. A spur gear 82 is secured to the output hub of the clutch 72 and engages with a second spur gear 84 secured on a shaft 86 to drive the gear 84 and the shaft 86 in a clockwise direction. Another gear 88 is secured on the shaft 86 and engages with and drives a spur gear 90 in a counterclockwise direction, the gear 90 being fixed to a shaft 92 which also carries and drives a drive roller 94 over which the receipt paper 61 is advanced to the left, as seen in FIG. 3, with the aid of pressure from an idler roller 96 supported from suitable means, not shown.

When the solenoid 76 is deenergized, the pawl 78 is released to contact the collar 74 wherein the pawl engages with a cog or tooth of the clutch release collar 74 to stop rotation of the output hub of the clutch 72. Energization of the solenoid 76 can be changed for various discrete angles of rotation of the clutch collar 74. A specific construction utilizes a clutch release collar 74 with ten cogs or teeth, a gear train ratio of two to one, and a drive roller 94 of slightly over one inch in diameter to provide paper feed spacing of six lines per inch. By interchanging release collars on the clutch 72 with collars having 12, eight, seven or five cogs, the approximate line spacing will be changed to seven, five, four, or three lines per inch, respectively.

A pair of guide and support rods or shafts 97 and 98 (FIGS. 1 and 2) support the drive mechanism for the receipt paper 61, the mechanism being a self-contained unit including the side plates 63 and 65 formed with the cut-outs 67 and 69 to provide support from the shafts 97 and 98. Since the shafts 97 and 98 extend across the machine, the receipt station clutch assembly and its associated drive mechanism can be located at any one of several positions along the shafts 97 and 98 for driving by the input shaft 64.

Figure 6:
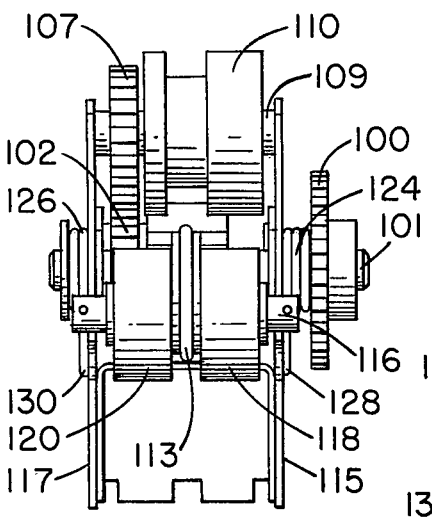
FIG. 6 is a front elevational view of the drive mechanism shown in FIG. 5.
Figure 5:
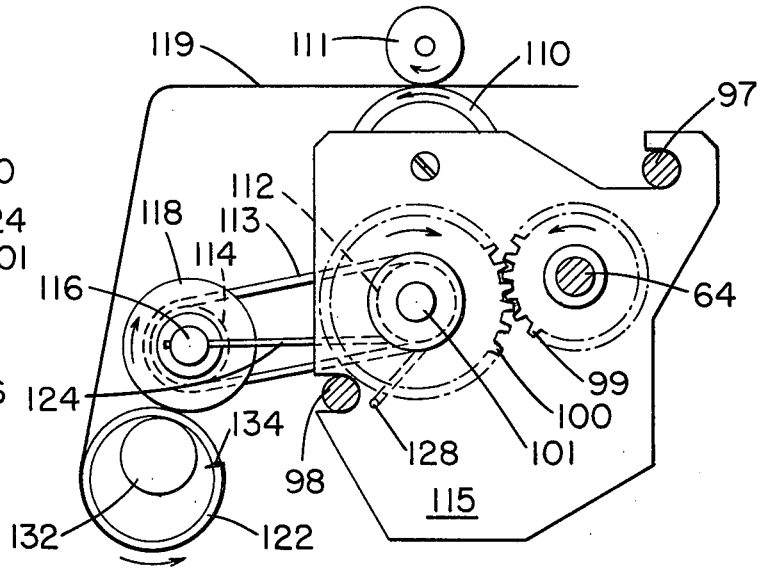
FIG. 5 is a right side elevational view of a drive mechanism for the journal or audit station of the printer.
Figure 8:
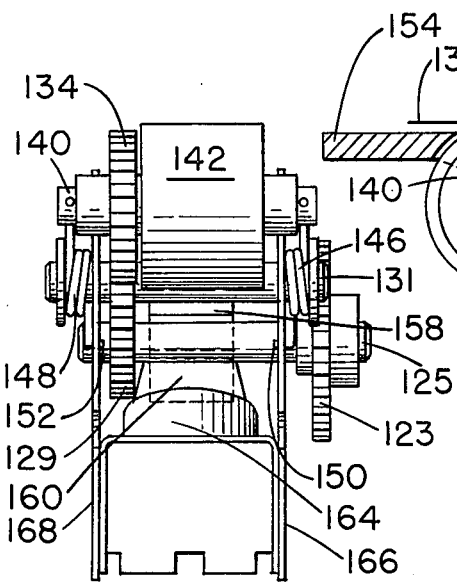
FIG. 8 is a front elevational view of the drive mechanism shown in FIG. 7.

The journal station 36 clutch assembly and drive mechanism (shown in FIGS. 5 and 6) is similar to the receipt station 34 clutch assembly and drive mechanism, and retains the modular or self-contained unit concept with additional drive elements to provide means for winding the journal paper on a storage roll. The input shaft 64 rotates in a counterclockwise direction (FIG. 5) and provides drive for a spur gear 99 secured to the output hub of the clutch (not shown, but similar to clutch 72 at the receipt station) and engages with a gear 100 secured to a shaft 101 for driving thereof in a clockwise direction, such shaft 101 also having a gear 102 (FIG. 6) secured thereto for driving a gear 107 fixed on a shaft 109 and a roller 110 in a counterclockwise direction for advancing the journal paper 119 across the roller 110 with the aid of an idler roller 111. The shaft 101 also has a pulley 112 fixed thereon for a belt or ring 113 connected with a pulley 114 journaled on a shaft 116 spaced from the shaft 101. The shaft 116 has a pair of drive rollers 118 and 120 (FIG. 6) carried thereon and adjacent the belt 113 and pulley 114 for engaging with the periphery of a take-up roll 122 (FIG. 5) for the journal paper 119, the drive rollers 118 and 120 being connected to the pulley 114 to be driven thereby. Support for the shaft 116 and for the rollers 118 and 120 is provided from a pair of spaced torsion springs 124 and 126 carried on and wound around the shaft 101 with each spring having a leg extending forwardly and through the shaft 116, the springs being retained in a preloaded condition by ends or pins 128 and 130 thereof projecting through side walls 115 and 117. The take-up roll 122 is inserted over a secured rod or tube 132, the roll 122 having an axial slot 134 therein for reception of one end of the journal paper 119. When the roll 122 is placed over the rod 132, the separation of the drive rollers 118 and 120 from the rod 132 by the wall thickness of the roll 122 forces the torsion springs 124 and 126 to be deflected in a clockwise direction (FIG. 5), thereby relieving the preload pressure placed thereon by the ends 128 and 130 of the torsion springs and transferring pressure to the rod 132 and the take-up roll 122 assembly.

It is seen that shaft 64 rotates the gear 99 counterclockwise, and the gear 100 along with the belt or ring 113 on pulley 112 and the drive rolls 118 and 120 in a clockwise direction. The take-up roll 122 is driven counterclockwise by surface engagement of the rollers 118, 120 with the roll 122 to wind the journal paper 119 therearound, with the pulleys 112 and 114 being sized in a ratio to rotate the drive rollers 118 and 120 through a slightly larger angle than the drive roller 110 in an overdriving of the rollers 118 and 120 to maintain the paper 119 under tension as it is being wound on the take-up roll 122. As the take-up roll 122 increases in diameter by reason of the journal paper 119 being wound thereon, the drive rollers 118 and 120 are riding on such increased diameter and the torsion springs 124 and 126 are angularly deflected further in a clockwise direction to provide continuously increasing pressure which aids in driving the enlarging roll of journal paper 119. In like manner as for the previously described receipt station, the journal station clutch assembly is generally contained between the side plates 115 and 117 which have formed cut-outs therein for the support or guide rods 97 and 98. Although not specifically shown, the clutch assembly includes a cogged collar for operation with a solenoid as described for the receipt station.

Figure 7:
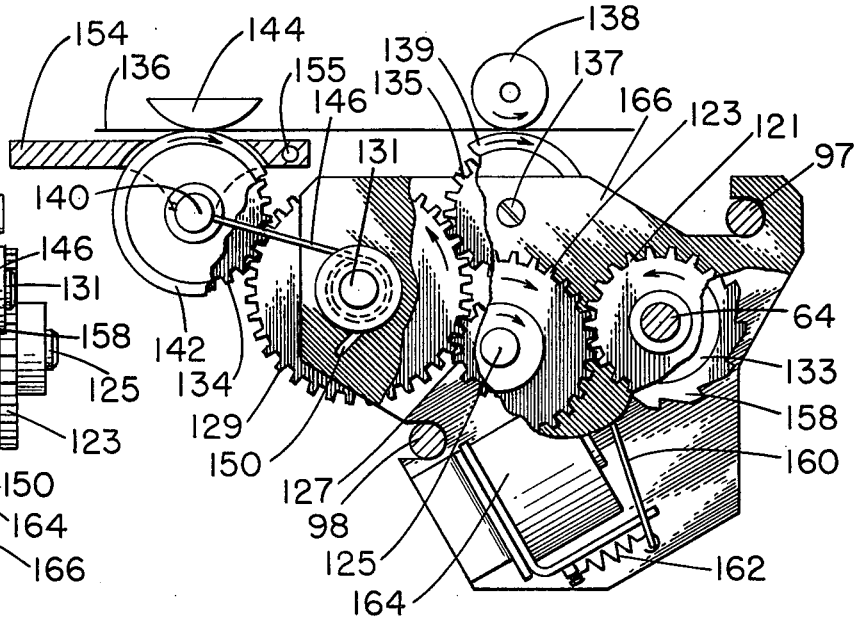
FIG. 7 is a right side elevational view of a drive mechanism for the slip or form station of the printer.

The slip or form station 38 clutch assembly and drive mechanism is likewise similar to that of the receipt and the journal stations and retains the modular or self-contained unit concept with additional drive elements to provide means for driving or feeding a slip or form in the direction opposite that of the receipt paper 61 and the journal paper 119. The input shaft 64 rotates in a counterclockwise direction (FIG. 7) and provides drive for a gear 121 secured to the output hub of the clutch 133, which gear 121 engages with a gear 123 fixed to a shaft 125 for driving thereof in the clockwise direction in addition to a gear 127 distal on the shaft 125 from gear 123. Gear 127 meshes with and drives a gear 129 secured to a shaft 131 in the counterclockwise direction, the gear 129, in turn, engaging a gear 135 fixed on a shaft 137, such shaft 137 having a roller 139 thereon for advancing slip or form paper 136 from left to right (FIG. 7) with the aid of an idler roller 138. The gear 129 on shaft 131 also engages with and drives a gear 134 carried on a shaft 140, the shaft 140 also having a driven roller 142 connected to the gear 134 for feeding the slip or form 136 across the roller 142 with the aid of an idler bar 144. In a manner similar to the journal station, support for the shaft 140, the gear 134, and for the driven roller 142 is provided from a pair of spaced torsion springs 146 and 148 carried on and wrapped around the shaft 131, each of the springs having a leg extending forwardly and through the shaft 140 and retained in a preloaded condition by ends or pins 150 and 152, projecting through the side walls of the module, to accommodate the passage of various sizes and thicknesses of slips or forms 136 past the printing station.

A slip or form table 154 is pivoted on pin 155 and when manually depressed at the forward or left portion thereof for insertion of a slip or form 136, the shaft 140 and the driven roller 142 are swung downwardly to separate the roller 142 from the idler bar 144. The slip or form 136 is inserted into the gap between the roller 142 and the bar 144, and the slip table is released to allow the roller 142 to engage with and advance the slip or form 136 in the rightward direction. It is seen that the drive roller 139 and the idler roller 138 (FIG. 7) are rotated in the opposite direction from their direction of rotation when used with the receipt (94, 96 of FIG. 3) and journal (110, 111 of FIG. 5) paper, however, the use of the rollers 142 and 139 or like drive means on each side of the slip or form printing station permits and makes possible the printing of both the leading and the trailing edge of the inserted slip or form 136. The form or slip station clutch assembly also includes the clutch member 133 and a cogged collar 158 engageable by a pawl 160 biased by a spring 162, the pawl being operated by a solenoid 164. In similar manner as the receipt and journal stations, the clutch and drive assembly for the form station is generally contained between side plates 166 and 168, with such side plates having cut-outs therein for the support or guide rods 97 and 98. A side plate 170, shown to the right of form station 38, is movable across the machine along with the form station module to accommodate form operation at another station or to accommodate wider forms.

The feed or drive mechanism for each assembly, whether for receipt, journal or slip function includes many of the same parts in the modular construction thereof, such as the side plates, the means for support of each mechanism, and the input drive shaft with its associated drive line. Each of the three clutch and drive mechanisms can be moved laterally along the supporting bars or shafts 97 and 98 to a desired position for the intended function by reason of such modular design. For example, if a machine is to perform only a receipt function, the receipt module will be inserted to operate at the receipt station but with minor modifications thereto, as shown and described, such module can be utilized at the journal station or at the form station. Likewise, if a machine is to perform only the journal function, that module can be inserted to operate at the journal station, but with modifications the module can be utilized at other stations. Additionally, if a slip or form function is desired, the slip or form module can be inserted for that function or with certain modifications can be used for another function at another print station. In the case of a machine performing two of the functions, two of the modules or units can be utilized and if different functions are desired, the modules can be located at different stations across the printer. The addition or subtraction of one or more driven rollers and their associated control mechanism enables the utilization of a modular unit which has a basic configuration common to the several printing functions. The slip or form module can be moved along the supporting members to accommodate different widths of slip media or forms, or there could be utilized two slip or form modules in a machine, or different combinations of the receipt, journal, and/or slip modules are available for the desired operations.

It is thus seen that herein shown and described is a drive or feed mechanism which is a self-contained unit and which includes basic construction details to which may be added parts or elements for performing one or more additional functions. The mechanism enables the accomplishment of the objects and advantages mentioned above, and while one basic embodiment with modifications thereto of the invention has been disclosed herein, variations thereof may occur to those skilled in the art. It is contemplated that all such variations, not departing from the spirit and scope of the invention hereof, are to be construed in accordance with the following claims.

What is claimed is:

1. Record media drive mechanism for accommodating a plurality of printing stations, at least one of said stations being a receipt station, a journal station, or a form station, said mechanism comprising a drive member extending in juxtaposition past said plurality of printing stations, modular means including roller means operably connected with said drive member for advancing record media in one direction of travel at one of said printing stations, said modular means including side frame members for journaling said drive member and for containing said roller means, and means engaging with said side frame members for supporting and along which said modular means is movable thereby permitting operation of said modular means at another printing station.

2. The mechanism of claim 1 wherein said modular means includes clutch means and roller means for advancing record media in a direction opposite said one direction of travel at another of said printing stations.

3. Record media drive mechanism for accommodating a plurality of printing stations including a journal station and at least one other station, said mechanism comprising frame means having spaced common side plates, means including at least one guide member fitting with and supporting said frame means side plates adjacent said printing stations, a drive member journaled in said side plates and extending along said printing stations, and driven means including roller means supported from and contained by said frame means side plates and operably connected with said drive member for intermittently advancing record media in one direction of travel at one of said printing stations, said frame means side plates being movable along said drive member and along said supporting means guide member thereby permitting operation of said driven means at another printing station.

4. The mechanism of claim 3 wherein said driven means includes clutch means and roller means for advancing record media in a direction of travel opposite said one direction of travel at another of said printing stations.

5. The mechanism of claim 3 wherein said driven means includes gears and rollers connected with said drive member for advancing record media in one direction of travel at a first or a second printing station and gears and rollers connected with said drive member for advancing record media in a direction opposite said one direction of travel at a third printing station.

6. The mechanism of claim 3 wherein one of said plurality of printing stations is a receipt station and said driven means includes a roller and a clutch member for intermittently driving said roller to advance a receipt at said station.

7. The mechanism of claim 3 wherein said driven means includes a roller and a clutch member for intermittently driving said roller to advance record media and to provide an audit of the transactions at said journal station.

8. The mechanism of claim 3 wherein one of said plurality of printing stations is a form station and said driven means includes a roller and a clutch member for intermittently driving said roller to advance a form at said station.

9. In a printer having a plurality of printing stations including a receipt station, a journal station, and a slip station, record media drive mechanism adaptable for operating at one or more of said printing stations, said mechanism comprising a frame having spaced common side plates, support means including spaced guide members carrying said frame, drive means journaled in said side plates and extending along said printing stations, and driven means including roller members carried by the frame and contained by said side plates and operably connected with said drive means for advancing record media in one direction of travel at one or another of said printing stations, said frame and said driven means being slidable along said support means guide members for operation at another station.

10. In the printer of claim 9 wherein said driven means includes roller members operably connected for advancing said record media in a direction of travel opposite said one direction.

11. In the printer of claim 9 wherein one of said printing stations is a receipt station and said driven means includes roller members for advancing said record media in one direction permitting printing of a receipt transaction.

12. In the printer of claim 9 wherein one of said printing stations is a journal station and said driven means includes roller members for advancing said record media in one direction permitting printing of an audit transaction and for retaining thereof in the printer.

13. In the printer of claim 9 wherein one of said printing stations is a slip station and said driven means includes roller members for advancing said record media in one direction permitting printing of a slip transaction.

14. In the printer of claim 11 wherein another of said printing stations is a form station and said driven means includes roller members for advancing said record media in the other direction permitting printing of a form transaction.

15. In the printer of claim 9 wherein one of said printing stations is a form station and said driven means includes roller members for advancing said record material permitting printing of a form transaction.

16. In a printer having a receipt station, a journal station, and a slip station, record media drive mechanism adaptable for operation at one or another of said stations, said mechanism comprising frame means having spaced common side plates, spaced guide means positioned across said printer and supporting said frame means therefrom, drive means journaled in said side plates and spanning said printer and having incremental actuating means associated therewith, and driven means including roller members contained in and carried by said frame means and connected with said actuating means for driving record media in one direction at said receipt and journal stations, and for driving record media in a direction opposite said one direction at said slip station.

17. In the printer of claim 16 wherein said driven means includes a plurality of gears and a roller for advancing said record media at said receipt and journal stations and said frame means comprises common members spaced for containing said driven means in modular manner for permitting movement of said driven means along said guide means and along said drive means for operation at another station.

18. In the printer of claim 16 wherein said driven means includes a plurality of gears and of rollers for advancing said record media at said slip station and said frame means comprises common members for containing said driven means in modular manner for permitting movement of said driven means along said guide means and along said drive means for operation at another station.

* * * * *